US007841844B2

(12) United States Patent
Park et al.

(10) Patent No.: US 7,841,844 B2
(45) Date of Patent: Nov. 30, 2010

(54) REFRIGERANTS SUCTION GUIDE STRUCTURE FOR RECIPROCATING COMPRESSOR

(75) Inventors: Kyeong-Bae Park, Seoul (KR); Eon-Pyo Hong, Seoul (KR); Ki-Chul Choi, Seoul (KR); Tae-Hee Kwak, Incheon (KR)

(73) Assignee: LG Electronics Inc., Seoul (KR)

( * ) Notice: Subject to any disclaimer, the term of this patent is extended or adjusted under 35 U.S.C. 154(b) by 1103 days.

(21) Appl. No.: 11/185,827

(22) Filed: Jul. 21, 2005

(65) Prior Publication Data

US 2006/0034712 A1 Feb. 16, 2006

(30) Foreign Application Priority Data

Aug. 16, 2004 (KR) ..... 10-2004-0064387

(51) Int. Cl.
*F04B 53/12* (2006.01)
*F04B 39/10* (2006.01)

(52) U.S. Cl. ..... 417/550; 417/417; 417/552

(58) Field of Classification Search ..... 417/396, 417/545, 550, 552, 417
See application file for complete search history.

(56) References Cited

U.S. PATENT DOCUMENTS

| | | | | |
|---|---|---|---|---|
| 1,003,200 | A * | 9/1911 | Peters | 417/550 |
| 1,765,097 | A * | 6/1930 | Robertson | 417/550 |
| 2,703,705 | A * | 3/1955 | Boller | 261/34.2 |
| 4,250,844 | A * | 2/1981 | Tews | 123/73 AV |
| 6,913,450 | B2 * | 7/2005 | Hong et al. | 417/545 |
| 2003/0180168 | A1 * | 9/2003 | Hong et al. | 417/550 |
| 2003/0206817 | A1 * | 11/2003 | Oh et al. | 417/417 |

FOREIGN PATENT DOCUMENTS

| | | | |
|---|---|---|---|
| DE | 103 02 303 | A1 | 11/2003 |
| DE | 103 12 355 | A1 | 3/2004 |
| JP | 11-37065 | A | 2/1999 |
| WO | WO-02/079649 | A1 | 10/2002 |
| WO | WO-02/095233 | A1 | 11/2002 |

* cited by examiner

*Primary Examiner*—Devon C Kramer
*Assistant Examiner*—Patrick Hamo
(74) *Attorney, Agent, or Firm*—Birch, Stewart, Kolasch & Birch, LLP

(57) ABSTRACT

A refrigerant suction guide structure of a reciprocating compressor is provided. The refrigerant suction guide structure includes a cylinder having an accommodating space inside, a piston having suction channels through which refrigerant is inhaled inside and inserted into the cylinder to be in a linear reciprocating motion, a suction valve included in the end of the piston to open and close the suction channels, and a valve fixing member for combining the suction valve with the piston. The suction channels of the piston include inclined surfaces for guiding refrigerant to the outside in which the suction valve is first opened. The suction channels are formed so as to be inclined to reduce flow resistance of inhaled refrigerant such that the amount of the inhaled refrigerant is increased. Therefore, it is possible to improve the efficiency of a compressor.

3 Claims, 7 Drawing Sheets

FIG.9

| | | | | | | | |
|---|---|---|---|---|---|---|---|
| Wc | W | 138.2 | 124 | 109.7 | 96.65 | 83.64 | 69.95 |
| Wc | % | 100 | 89.75 | 79.4 | 69.9 | 60.5 | 50.6 |
| Qe | W | 293.9 | 265.6 | 235.7 | 208 | 176.7 | 143.6 |
| Qe | % | 100 | 90.36 | 80.2 | 70.8 | 60.1 | 48.9 |
| EER | | 7.259 | 7.308 | 7.333 | 7.345 | 7.207 | 7.006 |

FIG.10

| | | | | | | | |
|---|---|---|---|---|---|---|---|
| Wc | W | 135.5 | 123.7 | 109.8 | 96.52 | 79.38 | 66.28 |
| Wc | % | 100 | 91.33 | 81.0 | 71.2 | 58.6 | 48.9 |
| Qe | W | 293.1 | 266.9 | 241.1 | 207.7 | 170.7 | 138.8 |
| Qe | % | 100 | 91.0 | 82.2 | 70.8 | 58.2 | 47.4 |
| EER | | 7.383 | 7.359 | 7.492 | 7.342 | 7.337 | 7.147 |

REFRIGERANTS SUCTION GUIDE STRUCTURE FOR RECIPROCATING COMPRESSOR

BACKGROUND OF THE INVENTION

1. Field of the Invention

The present invention relates to a refrigerant suction guide structure for a reciprocating compressor, and more particularly, to a refrigerant suction guide structure for a reciprocating compressor in which suction channel is inclined such that the flow resistance of inhaled refrigerant is reduced to increase the amount of inhaled refrigerant and to thus improve efficiency of a compressor.

2. Discussion of the Related Art

In general, a compressor is an apparatus for converting mechanical energy into compression energy of a compressive fluid and is used as a part of a freezing system such as a refrigerator and an air conditioner.

Among compressors, a reciprocating compressor linearly reciprocates an internal piston inside a cylinder to inhale, compress, and discharge a refrigerant gas. A method of driving the piston is divided into a recipro method and a linear method. According to the recipro method, a crankshaft is combined with a rotating motor and a piston is combined with the crankshaft to convert the rotary force of the motor into linear reciprocating motion. According to the linear method, a piston is connected to a mover of a motor that is in linear motion to reciprocate the piston by the linear motion of the motor.

FIG. 1 is a sectional view illustrating an example of such a reciprocating compressor. As illustrated in FIG. 1, according to a conventional reciprocating compressor, a suction pipe SP and a discharge pipe DP are connected to a sealed casing 10. A frame unit 20 is provided inside the casing 10. A reciprocating motor 30 for generating the driving force and a compression unit 40 for compressing refrigerant are fixed to the frame unit 20. The reciprocating motor 30 linearly reciprocates a mover 33 and is connected to a piston 42. The compression unit 40 includes a cylinder 41 fixed to the frame unit 20, the piston 42 including a suction channel inside, a suction valve 43 provided in the leading end of the piston 42 to limit the suction of a refrigerant gas, and a discharge valve assembly 44 provided in the discharge side of the cylinder 41 to limit the discharge of a compression gas while opening and closing a compression space P.

FIG. 2 is a sectional view illustrating the piston of a conventional reciprocating compressor. As illustrated in FIG. 2, the piston 42 includes a piston body 42A in which a first suction channel 47 is formed in a piston motion direction so as to be connected to the gas suction pipe SP of the casing 10 and a piston head 42B in which second suction channels 48 that are opened and closed by the suction valve 43 is formed in the end of the exit side of the first suction channel 47. One or a plurality of second suction channels 48 are formed to have the same diameter in the direction of a shaft.

FIG. 3 is a front view illustrating one end of the piston of the conventional reciprocating compressor and the suction valve. As illustrated in FIG. 3, the inside of the suction valve 43 is partially cut to be two-arm-shaped. One side of the suction valve 43 forms an opening and closing portion 43A for opening and closing the second suction channels 48 of the piston and the central portion of the suction valve 43 forms a fixing portion 43B fixed to the piston by a fastening bolt B.

In the drawing, the reference numeral 21 denotes a front frame, the reference numeral 22 denotes an intermediate frame, the reference numeral 23 denotes a rear frame, the reference numerals 31 and 32 denote external and internal stators, the reference numeral 31A denotes a winding coil, the reference numeral 33A denotes a magnet frame, the reference numeral 33B denotes a magnet, the reference numeral 45 denotes a discharge cover, the reference numeral 46 denotes a discharge spring, the reference numeral 50 denotes a resonance spring unit, the reference numeral 51 denotes a spring supporting stand, and the reference numerals 52 and 53 denote a front resonance spring and a rear resonance spring.

The above-described conventional reciprocating compressor operates as follows.

When power is applied to the reciprocating compressor 30 to form flux between an external stator 31 and an internal stator 32, a mover 33 in the slit between the external stator 31 and the internal stator 32 moves in the direction of the flux. The mover 33 is continuously reciprocated by the resonance spring unit 50 such that the piston 42 connected to the mover 33 is in a reciprocating motion inside the cylinder 41. Due to the reciprocating motion of the piston 42, the volume of a compression space P changes such that a series of processes of inhaling a refrigerant gas into the compression space to compress the refrigerant gas and then, discharging the refrigerant gas are repeated.

At this time, refrigerant is received to a sealed container through the suction pipe SP and reaches the compression space p through the first suction channel 47 and the second suction channels 48 formed in the piston 42 to be compressed. The suction valve 43 opens and closes the second suction channels 48 by the pressure difference between the suction channels 47 and 48 and the compression space P caused by the motion of the piston 42 such that the refrigerant is inhaled into the compression space P.

However, according to the above-described conventional reciprocating compressor, the suction valve 43 is fixed to the piston 42 by the fastening bolt B such that the opening and closing portion 43A is bent so as to be opened. Therefore, most refrigerant gas is inhaled into the outside of the suction valve that is opened to a relatively large degree. However, since the second suction channels 48 are formed to have the same diameter, due to channel resistance, the refrigerant gas is not smoothly inhaled. Solid lines, dotted lines, and arrows in FIG. 1 denote the flows of the refrigerant in the first and second suction channels 47 and 48. That is, all the air received through the suction channels does not enter the compression space P at the moment where the suction valve 43 is opened and remains in the suction channels such that the efficiency of the compressor deteriorates.

SUMMARY OF THE INVENTION

In order to solve the above-described problems, it is an object of the present invention to provide a refrigerant suction guide structure for a reciprocating compressor in which suction channel is inclined such that the flow resistance of inhaled refrigerant is reduced to increase the amount of inhaled refrigerant and to thus improve efficiency of a compressor.

In order to achieve the above object, there is provided a refrigerant suction guide structure of a reciprocating compressor comprising a cylinder having an accommodating space inside, a piston having suction channels through which refrigerant is inhaled inside and inserted into the cylinder to be in a linear reciprocating motion, a suction valve included in the end of the piston to open and close the suction channels, and a valve fixing member for combining the suction valve with the piston. The suction channels of the piston include inclined surfaces for guiding refrigerant to the outside in which the suction valve is first opened.

BRIEF DESCRIPTION OF THE DRAWINGS

The accompanying drawings are included to provide a further understanding of the invention, and are incorporated in and constitute a part of this specification. The drawings illustrate example embodiments of the present invention and, together with the description, serve to explain principles of the present invention. In the drawings:

FIG. 9 is a table illustrating the energy efficiency of a freezing system to which the conventional reciprocating compressor in which inclined surfaces are not formed is applied; and FIG. 10 is a table illustrating the energy efficiency of a freezing system to which the reciprocating compressor according to the first embodiment of the present invention in which inclined surfaces are formed is applied.

DETAILED DESCRIPTION OF THE ILLUSTRATED EMBODIMENTS

Hereinafter, a refrigerant suction guide structure of a reciprocating compressor according to the present invention will be described in detail with reference to the embodiments described with reference to the attached drawings.

Figure 1:
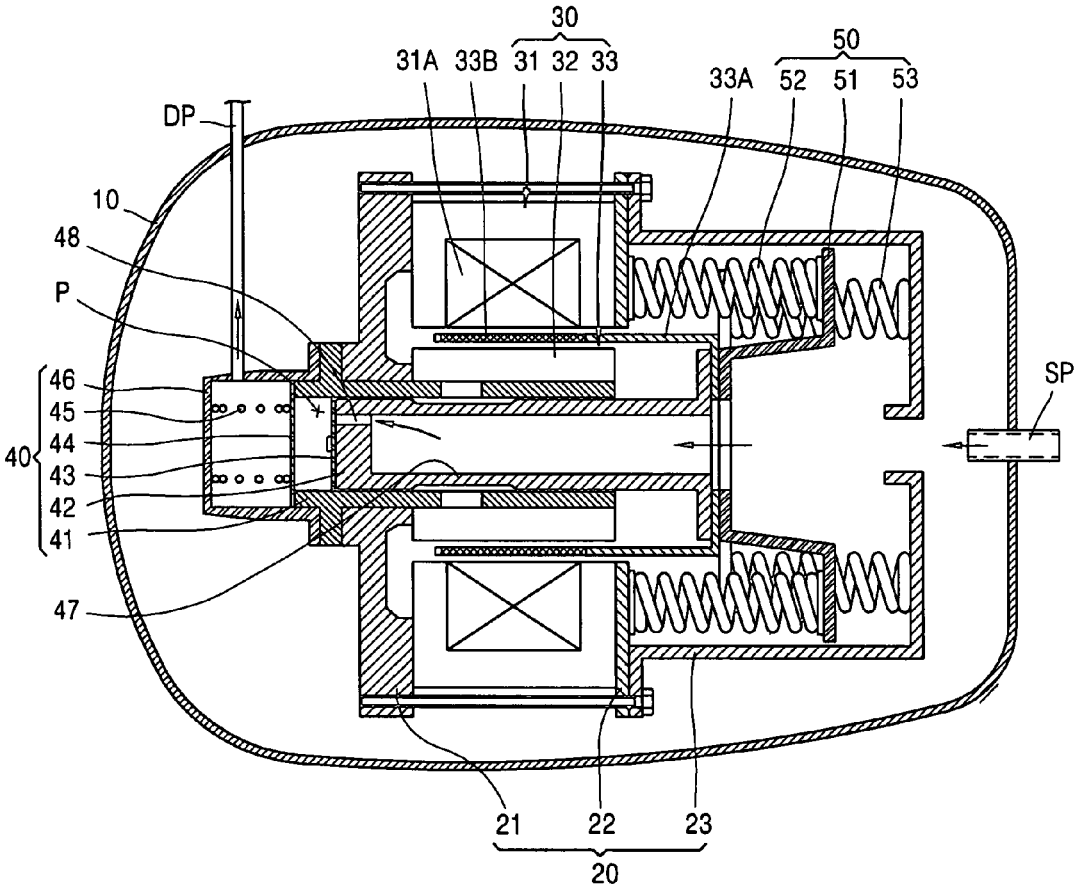
FIG.1 CONVENTIONAL ART.
FIG. 1 is a sectional view illustrating a conventional reciprocating compressor.
Figure 2:
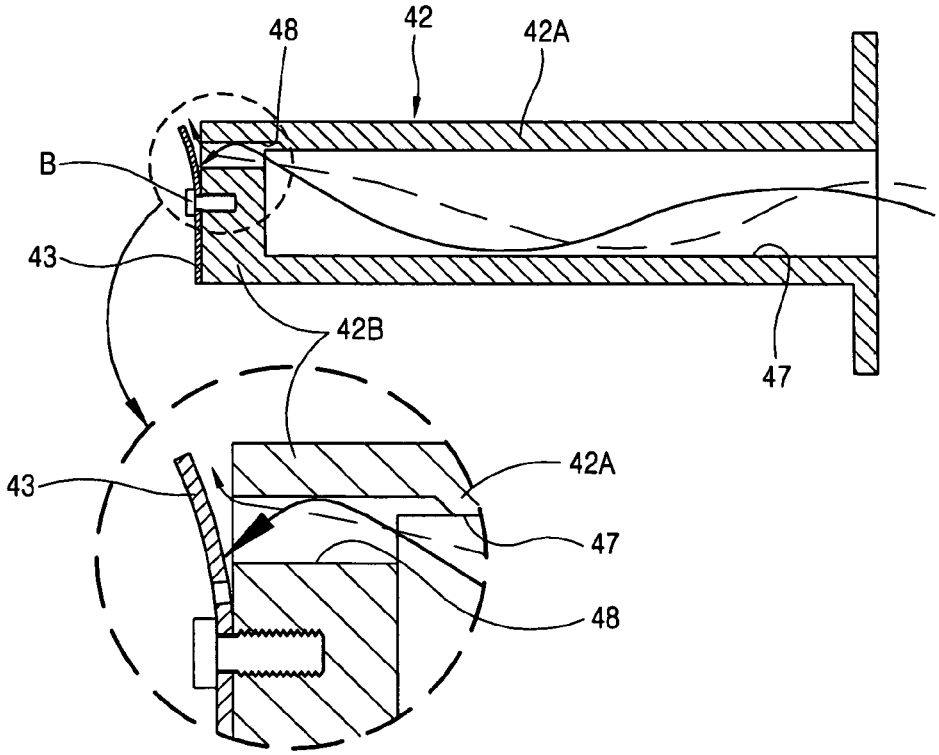
FIG.2 CONVENTIONAL ART.
FIG. 2 is a sectional view illustrating the piston of the conventional reciprocating compressor.
Figure 3:
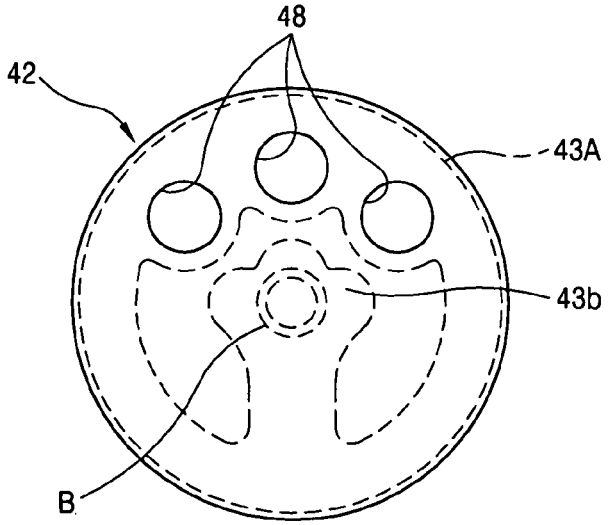
FIG.3 CONVENTIONAL ART.
FIG. 3 is a front view illustrating one end of the piston and the suction valve of the conventional reciprocating compressor.
Figure 4:
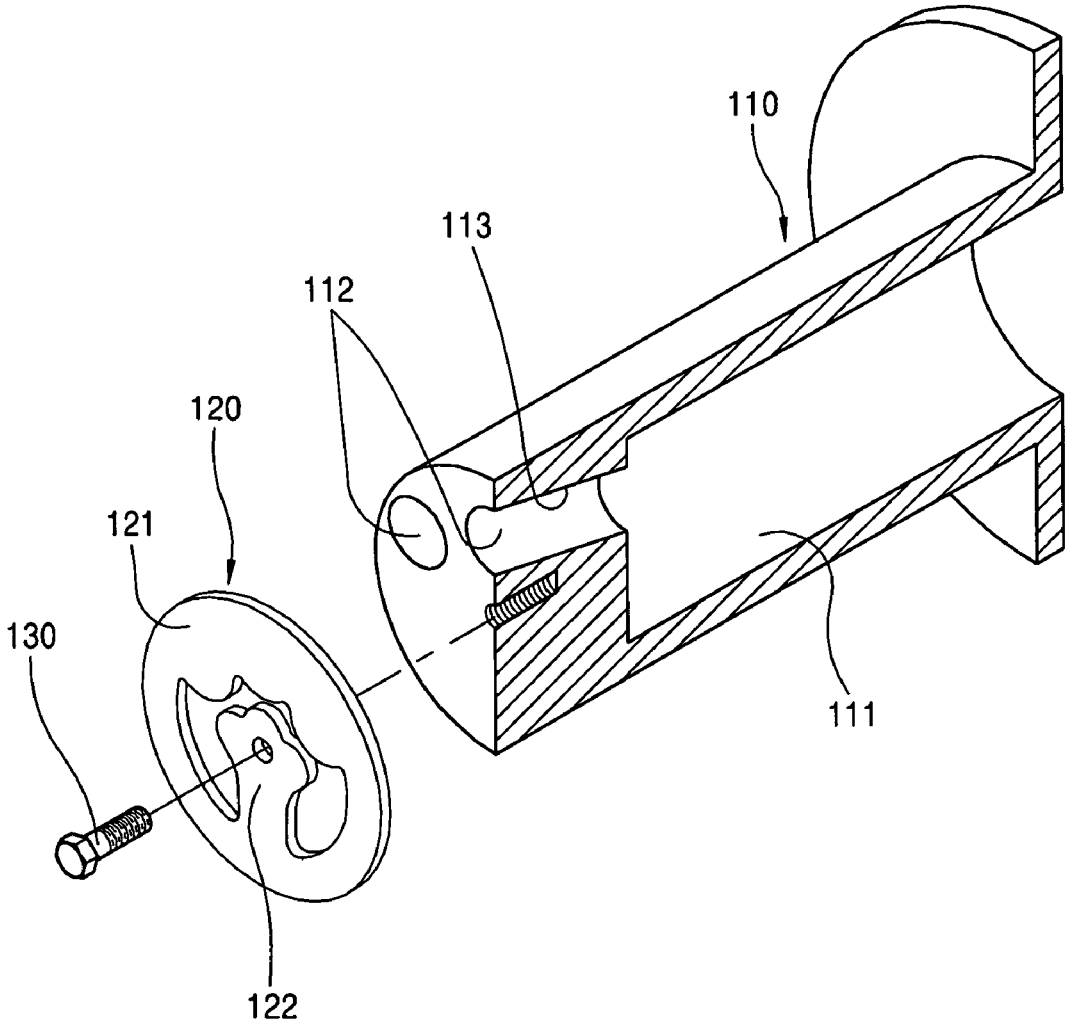
FIG. 4 is a sectional view illustrating the piston and the suction valve of a reciprocating compressor according to a first embodiment of the present invention.
Figure 5:
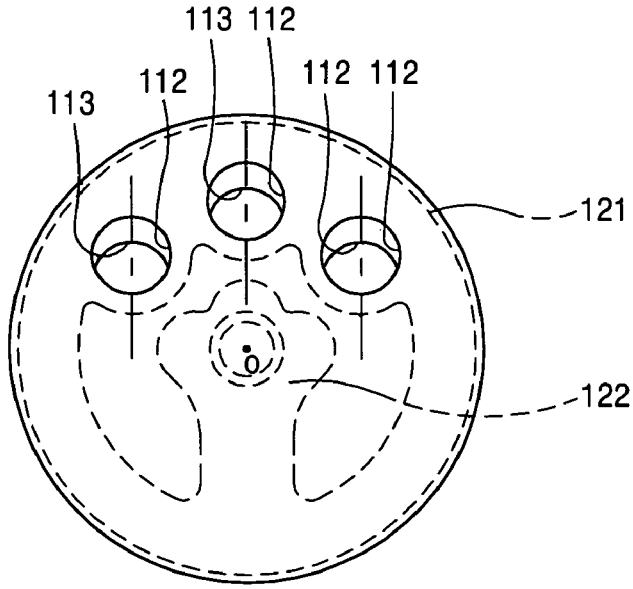
FIG. 5 is a front view illustrating one end of the piston and the suction valve of the reciprocating compressor according to the first embodiment of the present invention.

FIG. 4 is a sectional view illustrating the piston and the suction valve of a reciprocating compressor according to a first embodiment of the present invention. FIG. 5 is a front view illustrating one end of the piston and the suction valve of the reciprocating compressor according to the first embodiment of the present invention.

As illustrated in the drawings, the refrigerant suction guide structure of the reciprocating compressor according to the present invention includes a cylinder (not shown) that has an accommodating space inside, a piston 110 that includes suction channels 111 and 112 through which refrigerant is inhaled and that is inserted into the cylinder to be in a reciprocating motion, a suction valve 120 that is included in the end of the piston 110 to open and close the suction channels, and a valve fixing member 130 for combining the suction valve 120 with the piston 110. The suction channels of the piston 110 include inclined surfaces 113 that guide refrigerant to the outside in which the suction valve 120 is first opened.

The piston 110 includes the first suction channel 111 and the second suction channels 112 that are parts of the channels of refrigerant.

The first suction channel 111 is formed in the piston 110 in the direction of a shaft. The second suction channels 112 are connected to the first suction channel 111 and are formed in one end of the piston in the direction of a shaft so as to be inclined such that the second suction channels 112 are opened and closed by the suction valve 120.

The single first suction channel 111 passes through the central portion of the piston 110. The plurality of second suction channels 112 (the number of second suction channels is three according to the present embodiment) are eccentrically formed on the same circumference of the leading end of the piston to be separated from each other by the same distance so as to be connected to the first suction channel 111.

The suction valve 120 is obtained by performing sheet metal work on a ferroelastic material such that the inside thereof is partially cut to be two-arm-shaped. One side of the suction valve 120 forms an opening and closing portion 121 that contacts the second suction channels such that the respective second suction channels 48 of the piston 110 are opened and closed. The central portion of the suction valve 120 forms a fixing portion 122 fixed to the piston 110 by the valve fixing member 130.

The valve fixing member 130 may be the above-described bolt or the fixing portion 122 may be fixed to the piston 110 by welding.

The inclined surfaces 113 are preferably formed to be gradually inclined to the outside in the direction where refrigerant is inhaled so as to guide refrigerant to the side remote from the central portion in which the suction valve 120 is fixed, that is, to the outside considering that the second suction channels 112 are sequentially opened from the outside to the inside while the opening and closing portion 121 of the suction valve 120 is bent.

The inclined surfaces 113 are preferably formed on the second suction channels 112, however, may be formed on the first and second suction channels 111 and 112.

Figure 6:
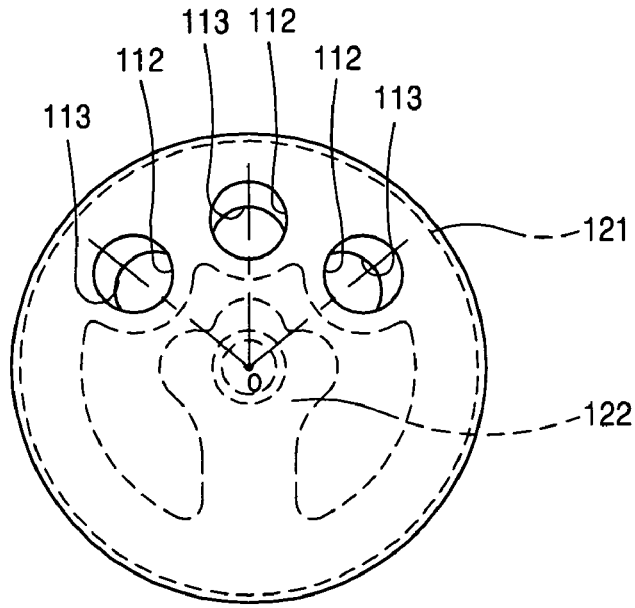
FIG. 6 is a front view illustrating the piston and the suction valve of a reciprocating compressor according to a second embodiment of the present invention.

FIG. 6 is a front view illustrating the piston and the suction valve of a reciprocating compressor according to a second embodiment of the present invention. As illustrated in FIG. 6, the inclined surfaces 113 may be formed so as to be radially inclined based on the fix point O in which the suction valve is fixed. That is, according to the first embodiment illustrated in FIGS. 4 and 5, the inclination direction is parallel. On the other hand, according to the second embodiment illustrated in FIG. 6, the inclined surfaces are radially inclined so as to more smoothly inhale refrigerant. The refrigerant is inhaled into the compression space P while being more diffused such that it is possible to reduce resistance of refrigerant.

Hereinafter, the operation of the present invention will be described as follows.

Figure 7:
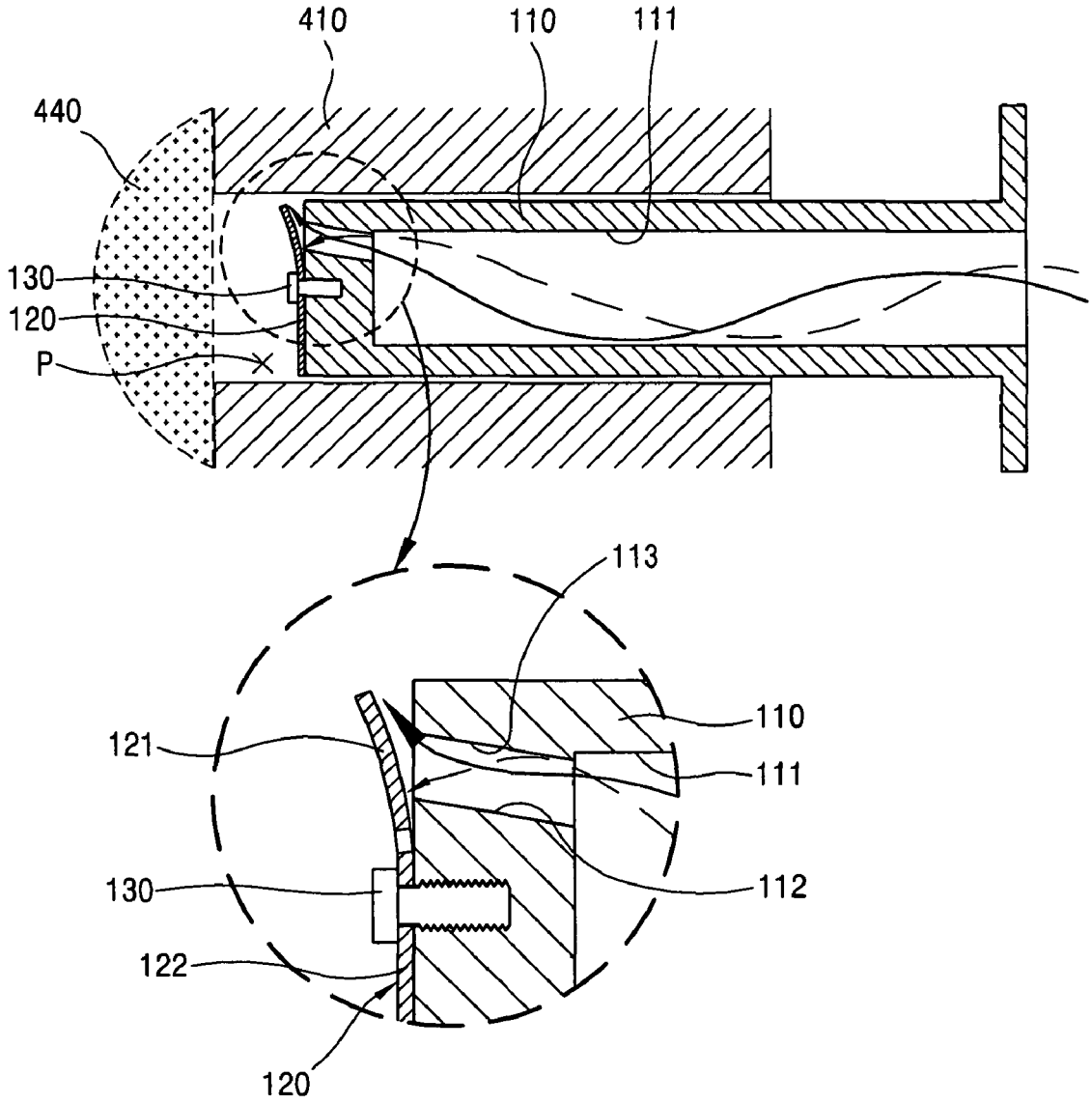
FIG. 7 is a sectional view illustrating the flow of refrigerant in the piston according to the embodiments of the present invention.

FIG. 7 is a sectional view illustrating the flow of refrigerant in the piston according to the embodiments of the present invention. As illustrated in FIG. 7, when the piston 110 inserted into a cylinder 410 retreats in order to inhale refrigerant, the suction valve 120 is opened due to the pressure difference between the suction channels and the compression space P. That is, when the piston 110 retreats, refrigerant receives force in the direction opposite to the movement direction of the piston 110. Due to such force of refrigerant, the opening and closing portion 121 of the suction valve 120 is bent based on the fixing portion 122 supported by the valve fixing member 130 and the second suction channels 112 are opened such that the refrigerant is rapidly received to the compression space P of the cylinder 410.

At this time, the inclined surfaces 113 are formed so as to be inclined to the outside toward the exit in accordance with the operation of opening the opening and closing portion 121 of the suction valve 120 such that most refrigerant is inhaled into the outside of the suction valve 120 and that flow resistance of refrigerant is reduced. Therefore, the refrigerant can rapidly pass through the second suction channels 112 such that it is possible to increase the amount of the inhaled refrigerant in the compression space.

Figure 8:
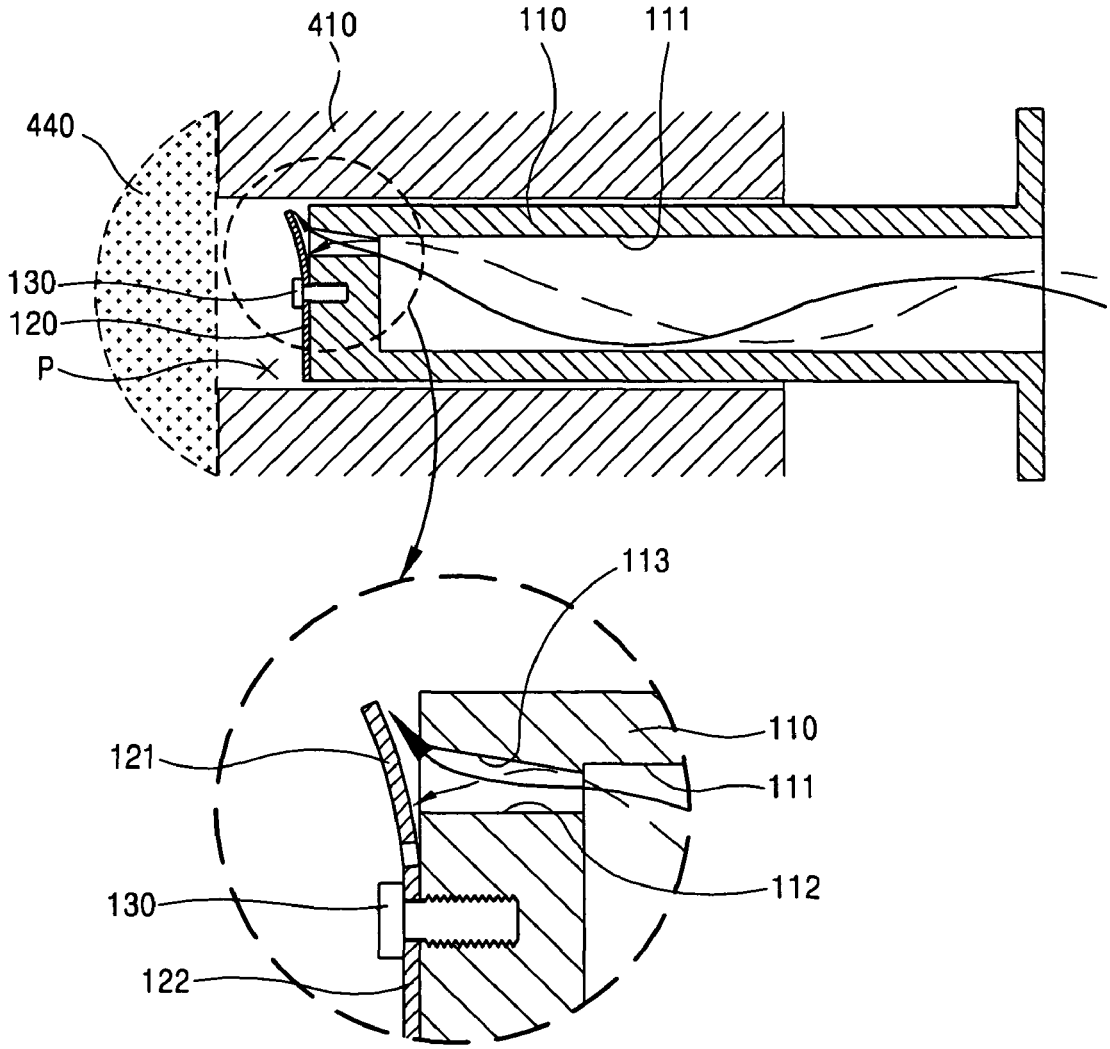
FIG. 8 is a sectional view illustrating the flow of refrigerant in a piston according to a third embodiment of the present invention.

FIG. 8 is a sectional view illustrating the flow of refrigerant in a piston according to a third embodiment of the present invention. As illustrated in FIG. 8, the inclined surfaces 113 are formed such that the internal circumferences of the second suction channels 112 in the outside are inclined to the outside toward the exit. That is, according to the first and second embodiments, the inclined surfaces 113 are formed so as to be inclined in parallel. On the other hand, according to the third embodiment, the internal circumferences in the inside are formed in parallel in the direction of the shaft and the inclined surfaces 113 are formed only on the internal circumferences in the outside.

An embodiment to which the second and third embodiments are applied may be formed. That is, the internal circumferences of the second suction channels 112 in the outside are formed so as to be inclined to the outside toward the exit such that the second suction channels 112 are radially inclined based on the fix point O in which the suction valve is fixed.

FIG. 9 is a table illustrating the energy efficiency of a freezing system to which the conventional reciprocating compressor in which inclined surfaces are not formed is applied. FIG. 10 is a table illustrating the energy efficiency of a freezing system to which the reciprocating compressor according to the first embodiment of the present invention in which inclined surfaces are formed is applied.

Here, Wc is work performed on the compressor in the freezing system and has a unit of [W]. Qe is a caloric value absorbed by an evaporator and has a unit of [W]. EER is energy efficiency ratio and can be obtained by Qe/Wc*3.4125. As illustrated in the drawings, the outputs (We) in FIG. 10 are larger than the outputs (We) in FIG. 9 with respect to the same inputs (Wc), from which it is noted that energy efficiency improves.

That is, according to the present invention, in the suction refrigerant structure of the reciprocating compressor, the inclined surfaces are formed in the suction channels to reduce flow resistance when the refrigerant is inhaled such that the refrigerant is rapidly inhaled into the compression space to increase the amount of the inhaled refrigerant. Therefore, it is possible to improve the performance of the compressor and the energy efficiency of the freezing system according to the present invention.

What is claimed is:

1. A refrigerant suction guide comprising:

a cylinder;

a piston having an interior space and a longitudinal axis;

a plurality of suction channels in the piston through which refrigerant passes from the interior space of the piston into the cylinder, the plurality of suction channels each having a first end and a second end, the second end being parallel to the first end;

a suction valve to open and close the plurality of suction channels; and the plurality of suction channels each having an axis passing through the center of the first end and the center of the second end, wherein the plurality of suction channels are formed in an edge portion of the piston, the suction valve being fixed in a center portion of the piston, wherein the plurality of suction channels are parallel to one another, and the axes of the suction channels are non-parallel to the piston longitudinal axis so as to be inclined toward an edge portion of the suction valve as the suction channel extends from the piston interior space.

2. The refrigerant suction guide of claim 1, wherein each of the plurality of suction channels has a frustroconical shape.

3. The refrigerant suction guide of claim 1, wherein the plurality of suction channels are all formed in one half of the piston.

* * * * *